US009121604B2

(12) United States Patent
Min

(10) Patent No.: US 9,121,604 B2
(45) Date of Patent: Sep. 1, 2015

(54) BOARD-PLANK PREMIXING BURNER PORT ARRANGEMENT

(75) Inventor: Tae-Sik Min, Seoul (KR)

(73) Assignee: KYUNGDONG NAVIEN CO., LTD., Gyeonggi-Do (KR)

( * ) Notice: Subject to any disclaimer, the term of this patent is extended or adjusted under 35 U.S.C. 154(b) by 409 days.

(21) Appl. No.: 13/698,298

(22) PCT Filed: Apr. 22, 2011

(86) PCT No.: PCT/KR2011/002921

§ 371 (c)(1),
(2), (4) Date: Nov. 16, 2012

(87) PCT Pub. No.: WO2011/145810

PCT Pub. Date: Nov. 24, 2011

(65) Prior Publication Data

US 2013/0059258 A1 Mar. 7, 2013

(30) Foreign Application Priority Data

May 19, 2010 (KR) ..... 10-2010-0046695

(51) Int. Cl.
*F23D 14/58* (2006.01)

(52) U.S. Cl.
CPC ..... *F23D 14/586* (2013.01); *F23D 2203/108* (2013.01); *F23D 2211/00* (2013.01)

(58) Field of Classification Search
CPC ..... F23D 14/586; F23D 2203/108
USPC ..... 431/328, 354
See application file for complete search history.

(56) References Cited

U.S. PATENT DOCUMENTS

| | | | | | |
|---|---|---|---|---|---|
| 1,768,234 | A * | 6/1930 | Davis | 239/552 |
| 2,484,123 | A * | 10/1949 | Scherl | 239/132.3 |
| 5,073,106 | A * | 12/1991 | Toyonaga et al. | 431/285 |
| 5,224,855 | A * | 7/1993 | Toyonaga et al. | 431/285 |
| 5,547,372 | A * | 8/1996 | Smith | 431/328 |
| 8,147,240 | B2 * | 4/2012 | Lyons et al. | 431/125 |
| 2011/0244411 | A1 * | 10/2011 | Rochat et al. | 431/354 |

FOREIGN PATENT DOCUMENTS

| | | | |
|---|---|---|---|
| GB | 1175868 | A * | 1/1970 |
| JP | 6-193832 | A | 11/1998 |
| KR | 10-0178309 | B1 | 11/1998 |
| KR | 10-2003-0021915 | A | 3/2003 |

OTHER PUBLICATIONS

Republic of Korea Intellectual Property Office, International Search Report in International Patent Application No. PCT/KR2011/002921, (Dec. 23, 2011).

* cited by examiner

*Primary Examiner* — Jorge Pereiro
(74) *Attorney, Agent, or Firm* — Leydig, Voit & Mayer, Ltd.

(57) ABSTRACT

A board-plank premixing burner port arrangement which increases durability by preventing a large force from being applied to a burner-fixing structure despite accumulated thermal expansion caused by red heat on a burner surface. A burner body unit includes partially cut and stacked plates. The plates form a gas mixture passage and a burner port, are disposed such that cut parts of the neighboring plates intersect one another. The board-plank premixing burner port arrangement has increased combustion efficiency by reducing burner port deformation, and is easily manufactured at a low cost through a simplified installation structure of the burner port.

9 Claims, 6 Drawing Sheets

BOARD-PLANK PREMIXING BURNER PORT ARRANGEMENT

TECHNICAL FIELD

The present invention relates to a board-plank premixing burner port arrangement, and more particularly, to a board-plank premixing burner port arrangement capable of absorbing a deformation occurring due to heat expansion according to accumulation of combustion heat by alternately disposing a burner body part and a burner port, thereby preventing a great force applied to a structure for fixing a burner and extending a lifespan of the burner.

BACKGROUND ART

Generally, gas burners used for combustion apparatuses such as boilers or water heaters may be divided into Bunsen burners and premixing burners depending on a method of mixing a gas for combustion with air.

In a Bunsen burner, a least amount of first air needed in combustion is supplied to a nozzle part and second excess air is supplied to a portion with flames formed thereon to perform perfect combustion, the Bunsen burner having excellent combustion safety but having a long length of flames because the flames are formed by the second excess air.

On the contrary, a premixing burner employs a method of burning a premixed gas manufactured by previously mixing a gas for combustion with air in a mixing chamber, the premixing burner being operated with a low air ratio to allow highly efficient and highly loaded combustion and of reducing occurrence of pollutants such as carbon monoxides and nitrogen oxides by reducing the entire length of flames simultaneously with decreasing the temperature of flames.

Generally, Bunsen burners are used, but recently premixing burners are mostly used to reduce occurrence of pollutants and minimize a combustion chamber.

Conventional premixing gas burners have a configuration in which air supplied from an air blower and combustion gas supplied via a gas supply pipe are previously mixed with each other inside a burner body and supplied to a burner port provided on top of the burner body.

A conventional burner port has a configuration in which there is a burner port formed on one board-plank formed in the shape of one of a flat panel and a cylinder, the configuration having problems such as a deformation of a burner combustion surface occurring due to thermal stress and imperfect combustion or a backfire caused by a damage of a burner port.

Also, according to a conventional burner port configuration, heat expansion is accumulated by red heat of a burner surface in low loaded combustion in such a way that a great force is applied to a structure for fixing a burner to make the structure vulnerable and to reduce durability thereof.

DISCLOSURE OF THE INVENTION

Technical Problem

To solve such problems as described above, the present invention provides a board-plank premixing burner port arrangement capable of preventing a great force from being applied to a structure for fixing a burner to extend a durable lifespan thereof though there is accumulated heat expansion occurring due to red heat of a burner surface.

The present invention also provides a board-plank premixing burner port arrangement capable of being easily installed and reducing manufacturing costs thereof

Technical Solution

To achieve the objects described above, a board-plank premixing burner port arrangement according to an embodiment of the present invention features a burner body unit formed by overlapping a plurality of partially cut plates and a gas mixture passage and burner ports formed by alternately disposing cut parts of adjacent ones of the plurality of plates, which are formed therein.

In this case, the burner body unit includes inner plates including sets of plates overlapped repeatedly, a side of each of the plates being partially exposed between adjacent plates, and outer plates bonded to a front surface and a rear surface of the inner plates and sealing front and rear surfaces of the gas mixture passage.

Also, the inner plates may include body elements disposed on both sides thereof, a plurality of T-shaped elements disposed between the body elements with a certain interval, and fastening elements laterally installed between both the body elements and coupling the body elements and the plurality of T-shaped elements with one another.

Also, the inner plates may be formed of adjacent plates having different widths of the body elements thereof in such a way that contact surfaces between the T-shaped elements of the adjacent plates are alternately disposed.

Also, the burner port is formed by a space between top ends of the adjacent T-shaped elements.

Also, locations where the fastening elements are coupled with the T-shaped elements may be separated from one another between adjacent inner plates in such a way that a gas mixture flowing inside a bottom of one of the inner plates is diverted from a passage thereof due to the fastening elements, passes through a space inside the adjacent inner plates, and is discharged via the burner ports formed on top thereof.

Also, both longitudinal sides of a bottom surface of the burner body unit may be coupled with bottom supporting frames where fitting grooves with shapes corresponding to a shape of the bottom surface of the burner body unit and fastened thereto while the plates are overlapped with one another.

Advantageous Effects

According to a board-plank premixing burner port arrangement, since a burner port part is formed by overlapping a plurality of partially cut plates and a burner body unit and burner ports intersect with one another to absorb heat expansion on a surface of a burner by the configuration thereof, it is possible to prevent applying a great force to a structure for fixing the burner and to extend a durable lifespan of the burner.

Also, according to the present embodiment, it is possible to reduce degrees of a deformation in the burner port occurring due to thermal stress in such a way that stability of flames is increased and imperfect combustion is prevented, thereby improving combustion efficiency.

Also, according to the present embodiment, since a burner body unit is formed by overlapping a plurality of plates and a burner port part is installed by mounting the burner body unit on bottom supporting frames and fastening the burner body unit thereto and coupling side supporting frames therewith, it is easy to manufacture a burner and it is possible to reduce manufacturing costs thereof.

DESCRIPTION OF REFERENCE NUMERALS IN THE DRAWINGS

Figure 1:
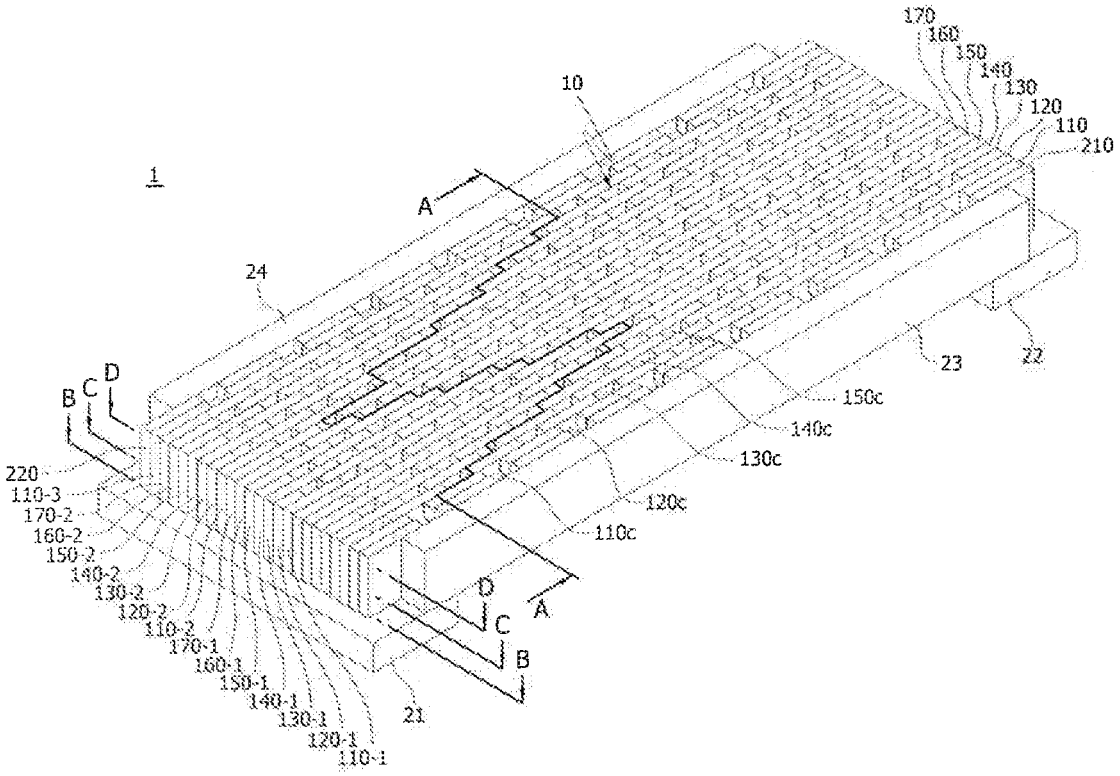
FIG. 1 is a perspective view illustrating a board-plank premixing burner port arrangement according to an embodiment of the present invention.

1: burner port part 10: burner body unit
21, 22: bottom supporting frames 23, 24: side supporting frames
100: inner plates 110: first inner plate
120: second inner plate 130: third inner plate
140: fourth inner plate 150: fifth inner plate
160: sixth inner plate 170: seventh inner plate
111*a*, 111*b*, 121*a*, 121*b*, 131*a*, 131*b*, 141*a*, 141*b*: body elements
112, 113, 114, 115, 116, 117, 118: T-shaped elements
119, 129, 139, 149, 159, 169, 179: fixing elements
130*a*, 150*a*, 170*a*: gas mixture inlets
110*b*, 120*b*, 140*b*, 160*b*: inner spaces
110*c*, 120*c*, 130*c*, 140*c*, 150*c*: burner ports
210, 220: outer plates

MODE FOR CARRYING OUT THE INVENTION

Hereinafter, there will be described in detail a configuration and operations of exemplary embodiments of the present invention with reference to the attached drawings.

Figure 2:
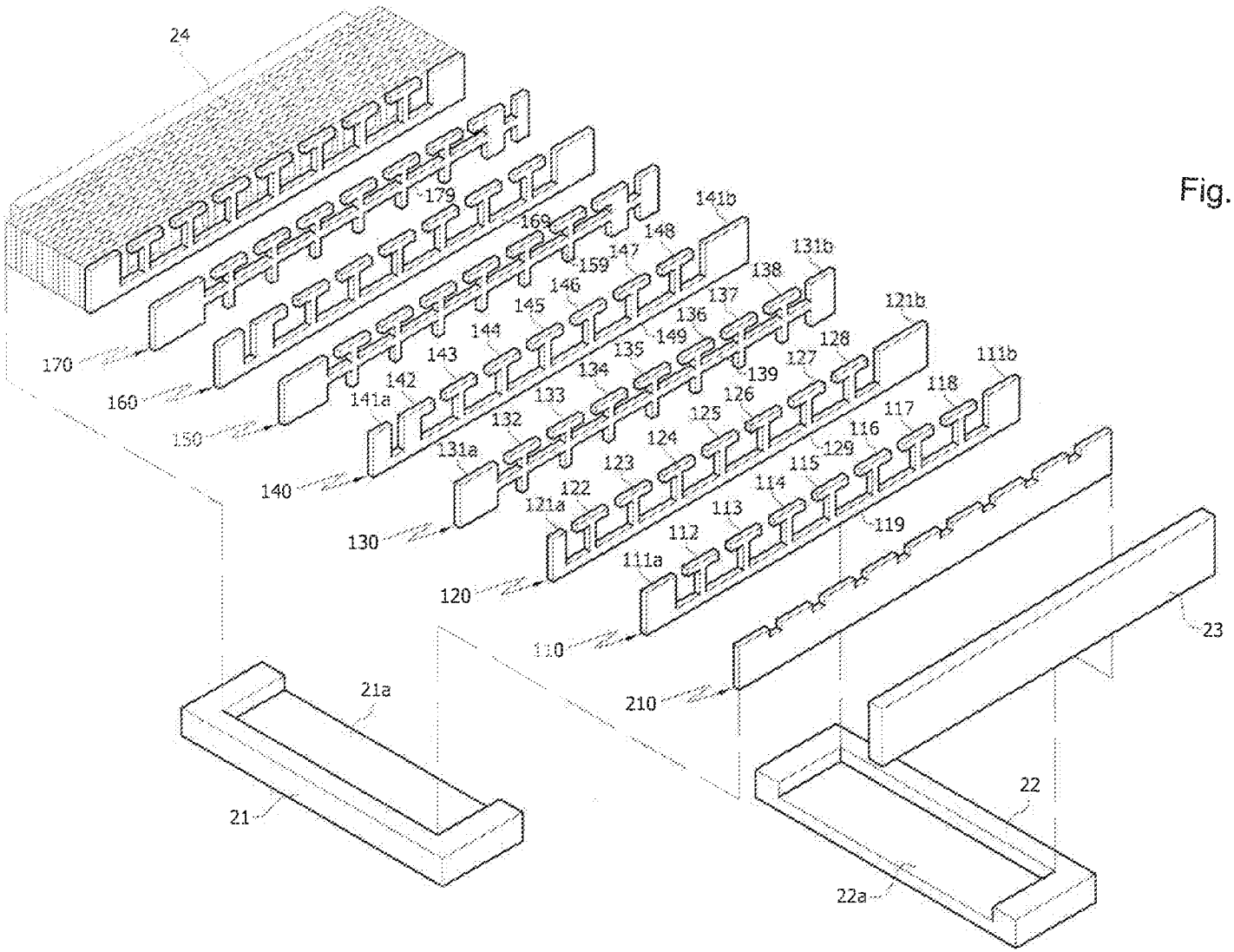
FIG. 2 is an exploded perspective view illustrating the arrangement of FIG. 1.
Figure 3:
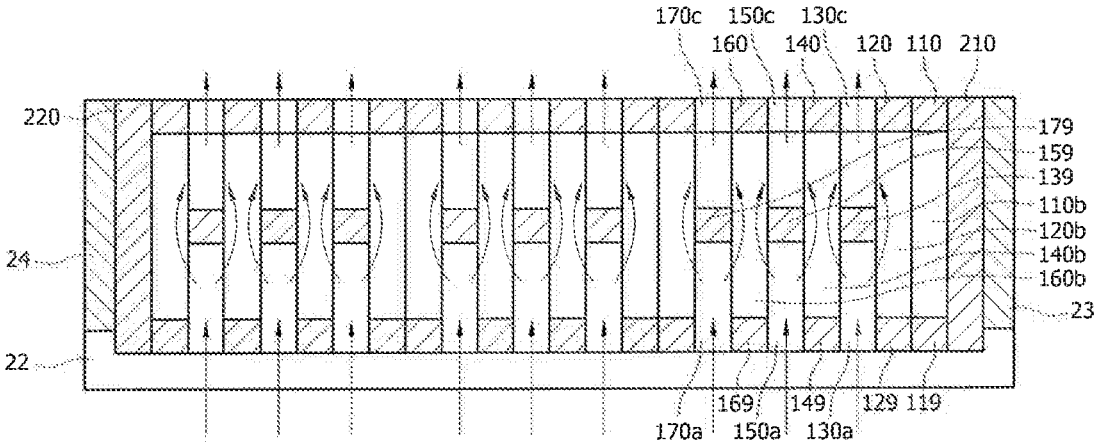
FIG. 3 is a cross-sectional view illustrating the arrangement of FIG. 1 cut along line A-A.

FIG. 1 is a perspective view illustrating a board-plank premixing burner port arrangement according to an embodiment of the present invention, FIG. 2 is an exploded perspective view illustrating the burner port arrangement of FIG. 1, and FIG. 3 is a cross-sectional view illustrating a cross-sectional view illustrating the burner port arrangement of FIG. 1 cut along line A-A.

A board-plank premixing burner port part 1 according to the present embodiment includes a burner body unit 10 formed by overlapping a plurality of partially cut plates and gas mixture passages and burner ports 110*c*, 120*c*, 130*c*, 140*c*, and 150*c* interacting with one another via gaps between partially cut parts of the overlapped plates in such a way that the burner body unit 10 and the burner ports 110*c*, 120*c*, 130*c*, 140*c*, and 150*c* intersect one another.

Referring to FIGS. 1 and 2, the burner port part 1 includes the burner body unit 1 and bottom supporting frames 21 and 22 and front and rear side supporting frames 23 and 24 fixing and supporting the burner body unit 10.

The burner body unit 10 includes inner plates 100 formed by repeatedly overlapping sets of plates 110, 120, 130, 140, 150, 160, and 170, a side of each of the plates being partially exposed between adjacent ones of the plates, and outer plates 210 and 220 bonded to a front surface and a rear surface of the inner plates 100 and sealing front and rear surfaces of gas mixture passages formed inside the inner plates 100.

In FIG. 1, reference numerals 110-1, 120-1, 130-1, 140-1, 150-1, 160-1, 170-1, 110-2, 120-2, 130-2, 140-2, 150-2, 160-2, 170-2, and 110-3 not described above indicate plates formed by repeatedly overlapping the sets of the plates 110, 120, 130, 140, 150, 160, and 170.

The bottom supporting frames 21 and 22 are for supporting both longitudinal sides of a bottom surface of the burner body unit 10 and for maintaining an overlapping state of the burner body unit 10, fitting grooves 21*a* and 22*a* formed in the shape of a rectangular parallelepiped corresponding to shapes of the both sides of the bottom surface of the burner body unit 10 are formed on top of the bottom supporting frames 21 and 22, and the both sides of the bottom surface of the burner body unit 10 are mounted on inside the fitting grooves 21*a* and 22*a* and coupled therewith.

In the present embodiment, the inner plates 100 has a configuration in which a set of the first to seventh inner plates 110, 120, 130, 140, 150, 160, and 170 is arranged repeatedly three times, the number of the plates forming one set and the number being arranged repeatedly being not limited thereto but depending on capacity of the burner and installation environment thereof.

Referring to FIG. 2, the first to seventh inner plates 110, 120, 130, 140, 150, 160, and 170 forming one set of the inner platens 100 are formed in different shapes from one another, but a part is formed between adjacent plates through a gap formed thereinside in such a way that a passage of a gas mixture is formed, the passage of a gas mixture being connected to the burner ports 110*c*, 120*c*, 130*c*, 140*c*, and 150*c* formed with a certain interval on top thereof.

Describing a configuration of the inner plates 100, as an example, the first inner plate 110 includes body elements 111*a* and 111*b* disposed on both sides, a plurality of T-shaped elements 112, 113, 114, 115, 116, 117, and 118 disposed with a certain interval between the body elements 111*a* and 111*b*, and a fastening element 119 laterally installed between the body elements 111*a* and 111*b* and fastening the body elements 111*a* and 111*b* and the T-shaped elements 112, 113, 114, 115, 116, 117, and 118. In this case, the body elements 111*a* and 111*b*, the T-shaped elements 112, 113, 114, 115, 116, 117, and 118, and the fastening element 119 receive names and reference numerals thereof just for convenience for description but may be formed in a single body.

Also, similarly thereto, the second inner plate 120, the third inner plate 130, and the fourth inner plate 140 sequentially overlapped in rear of the first plate 110 may include body elements 121*a*, 121*b*, 131*a*, 131*b*, 141*a*, and 141*b*, T-shaped elements 122 to 128, 132 to 138, and 142 to 148, and fastening elements 129, 139, and 149, and the fifth to seventh inner plates 150, 160, and 170 in rear thereof may be formed in the same pattern as those thereof.

In this case, the body elements 111*a*, 111*b*, 121*a*, 121*b*, 131*a*, 131*b*, 141*a*, and 141*b* are formed with different widths from those of adjacent plates and contact surfaces of the T-shaped elements 112 to 118, 122 to 128, 132 to 138, and 142 to 148 between the adjacent plates do not coincide with one another but intersect with one another in such a way that the passage of a gas mixture may be laterally transferred in an inner space of the adjacent plates.

Also, the T-shaped elements 112 to 118, 122 to 128, 132 to 138, and 142 to 148 may be formed in the same shape largely and there are formed the burner ports 110*c*, 120*c*, 130*c*, 140*c*, and 150*c* in spaces between top portions of adjacent T-shaped elements.

Also, locations where the fastening elements 119, 129, 139, and 149 are coupled with the T-shaped elements 112 to 118, 122 to 128, 132 to 138, and 142 to 148 may be formed to alternately dispose separate patterns top and bottom between the adjacent inner plates.

That is, as shown in FIG. 2, in case of the second inner plate 120, the fourth inner plate 140, and the sixth inner plate 160, the fastening elements 129, 149, and 169 may be coupled with bottom ends thereof, and in case of the third inner plate 130, the fifth inner plate 150, and the seventh inner plate 170 disposed therebetween, the fastening elements 139, 159, and 179 may be coupled with medium portions in a direction of top and bottom of the T-shaped elements.

As described above, the fastening elements 129, 139, 149, 159, 169, and 179 of the plates forming the inner plates 100 are disposed to be alternately separate top and bottom, thereby forming gas mixture inlets 130*a*, 150*a*, and 170*a* on bottom ends of the third inner plate 130, the fifth inner plate 150, and the seventh inner plate 170 as shown in FIG. 3. Also, inside medium portions of the second inner plate 120, the fourth inner plate 140, and the sixth inner plate 160, there are formed inner spaces 120*b*, 140*b*, and 160*b* to change a passage of a gas mixture flowing inside through the gas mixture inlets 130*a*, 150*a*, and 170*a* into a direction of both sides on FIG. 3. Also, on top ends of the third inner plate 130, the fifth inner plate 150, and the seventh inner plate 170, there are formed the burner ports 130*c*, 150*c*, and 170*c* via which the gas mixture whose passage is changed from the inner spaces 120*b*, 140*b*, and 160*b* is discharged.

Figure 4:
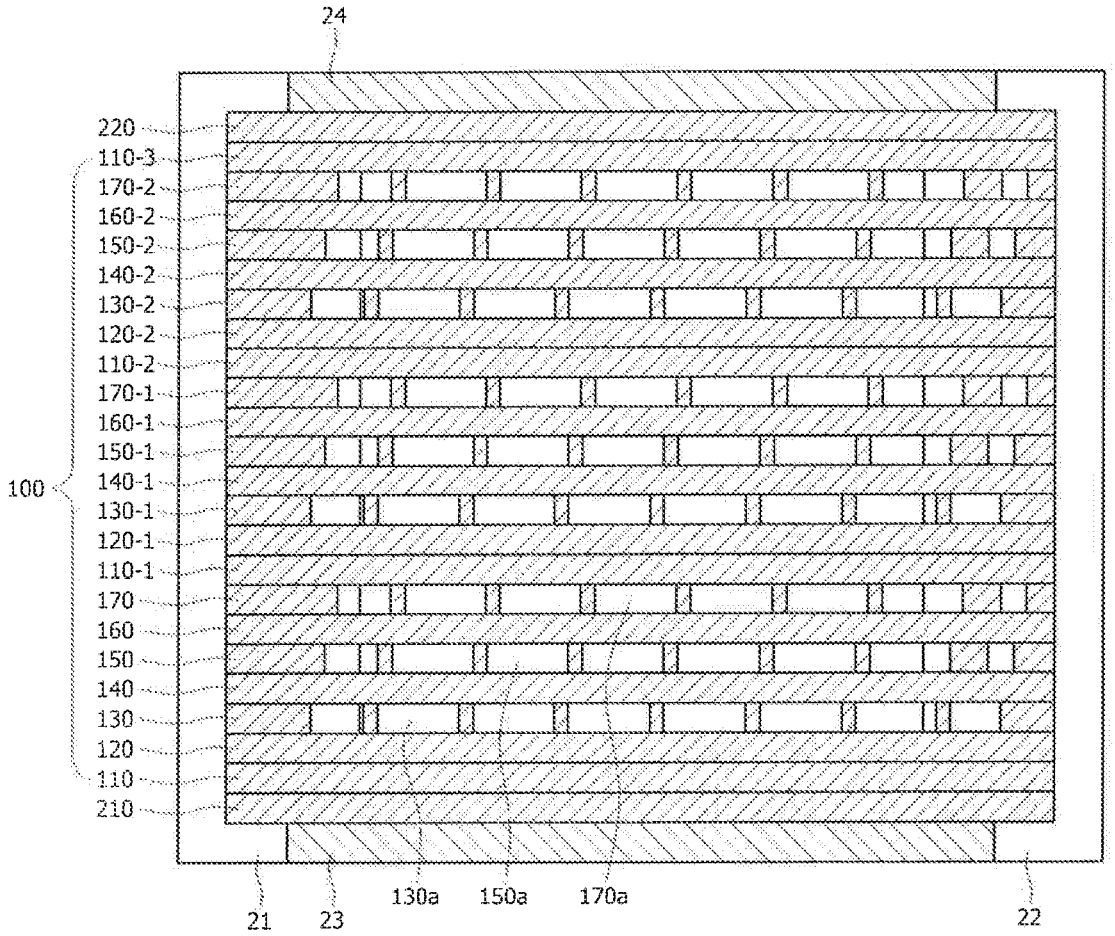
FIG. 4 is a cross-sectional view illustrating the arrangement of FIG. 1 cut along line B-B.
Figure 5:
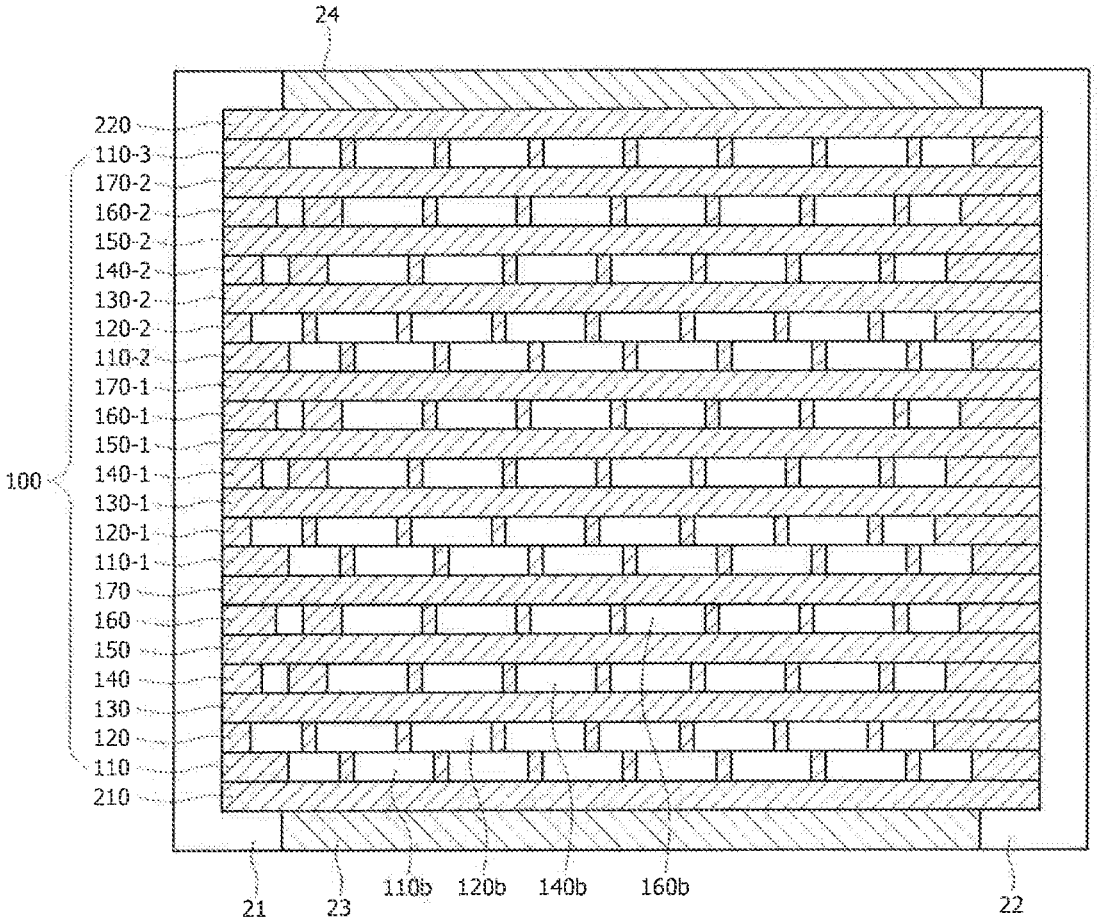
FIG. 5 is a cross-sectional view illustrating the arrangement of FIG. 1 cut along line C-C.
Figure 6:
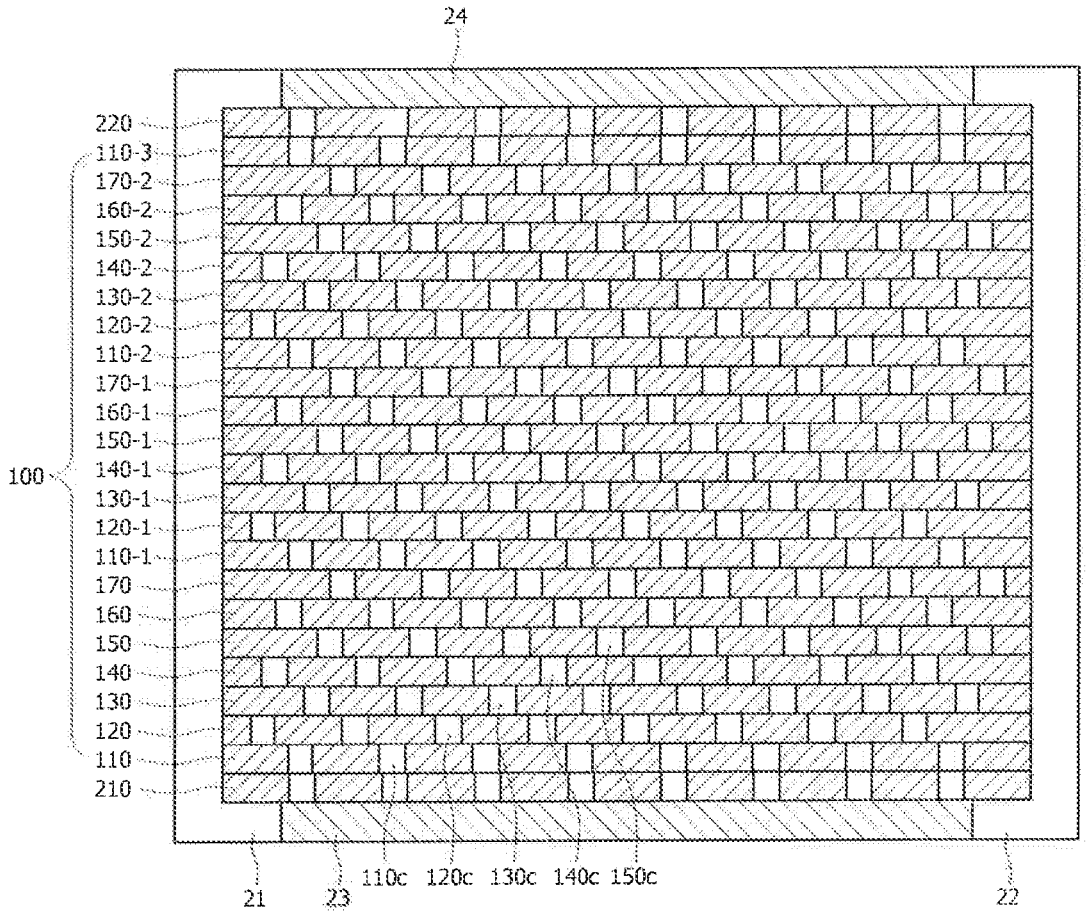
FIG. 6 is a cross-sectional view illustrating the arrangement of FIG. 1 cut along line D-D.

FIG. 4 is a cross-sectional view illustrating the arrangement of FIG. 1 cut along line B-B in which the gas mixture inlets 130*a*, 150*a*, and 170*a* are formed on a bottom end of the burner body unit 10, FIG. 5 is a cross-sectional view illustrating the arrangement of FIG. 1 cut along line C-C in which the inner spaces 110*b*, 120*b*, 140*b*, and 160*b* where the gas mixture is transferred are formed in a medium of the burner body unit 10, and FIG. 6 is a cross-sectional view illustrating the arrangement of FIG. 1 cut along line D-D in which the burner ports 110*c*, 120*c*, 130*c*, 140*c*, and 150*c* are formed on a top end of the burner body unit 10, such patterns being formed repeatedly on the overlapped plates.

As described above, according to the board-plank premixing burner port arrangement according to the present embodiment, since there is provided a configuration in which a burner body unit is formed by overlapping a plurality of partially cut plates with one another, inside which a gas mixture passage is provided and connected to burner ports on top thereof, though the plates forming the burner ports are thermally expanded due to accumulation of combustion heat occurring while burning, it is possible to absorb an expanded volume by using gaps among the overlapped plates to prevent applying a great force to a structure for fixing the burner body unit and to extend durable lifespan of a burner.

Also, since a burner body unit with a gas mixture passage and burner ports formed therein is formed by overlapping a plurality of plates and a burner port part is installed by mounting the burner body unit on bottom supporting frames and fastening the burner body unit thereto and coupling side supporting frames therewith, it is easy to manufacture a burner and it is possible to reduce manufacturing costs thereof.

The invention claimed is:

1. A burner port arrangement comprising:

an inner plate having front and rear surfaces and including, between the front and rear surfaces, sequentially arranged, a plurality of sets of cut plates; and first and second outer plates respectively bonded to the front surface and the rear surface of the inner plate and sealing gas mixture passages of the burner port arrangement at the front and rear surfaces of the inner plate, wherein each of the sets of cut plates includes a plurality of overlapped cut plates, each of the cut plates within a set of cut plates is partially exposed between an adjacent pair of the cut plates, each of the cut plates includes a pair of body elements disposed at opposite ends of the respective cut plate, a plurality of T-shaped elements disposed between the body elements and spaced apart from each other, and a fastening element extending laterally between and connected to the body elements and to the T-shaped elements, coupling the body elements to the plurality of T-shaped elements, and adjacent cut plates are overlapped and joined to each other thereby forming, in spaces between the T-shaped elements, at least one gas mixture passage for the passage of a gas mixture and, between top surfaces of the T-shaped elements, at least one burner port for escape and burning of the gas mixture.

2. The burner port arrangement of claim 1, wherein the body elements of adjacent cut plates have different respective widths, and the T-shaped elements of adjacent cut plates contact at surfaces that are offset with respect to each other along a direction extending between the body elements of the respective cut plates.

3. The burner port arrangement of claim 1, wherein the fastening elements of adjacent cut plates are offset from each other in a direction transverse to the fastening elements so that spaces between the fastening elements and the T-shaped elements of adjacent cut plates divert the flow of the gas mixture flowing toward the burner port.

4. The burner port arrangement of claim 1 wherein the burner body unit includes a bottom surface and longitudinal sides and further comprising first and second bottom supporting frames having respective recesses complementary to and engaging respective parts of the longitudinal sides and bottom surface of the burner body unit.

5. A burner port arrangement comprising:

a burner body unit including a plurality of overlapping partially cut plates, wherein the burner body unit includes inner plates comprising sets of plates overlapped repeatedly, wherein each of the inner plates is partially exposed between adjacent inner plates, and each of the inner plates comprises body elements disposed on opposite ends of the inner plates, a plurality of T-shaped elements disposed between the body elements at an interval, and fastening elements located laterally between the body elements and coupling the body elements and the plurality of T-shaped elements with one another, and outer plates bonded to a front surface and a rear surface of the inner plates and sealing front and rear surfaces of the gas mixture passage; and a gas mixture passage and burner ports defined by alternating cut parts of adjacent plates of the partially cut plates.

6. The burner port arrangement of claim 5, wherein the inner plates include adjacent plates having different widths so that contact surfaces between the T-shaped elements of the adjacent plates are alternately disposed.

7. The burner port arrangement of claim 5, wherein the burner port includes a space between top ends of adjacent T-shaped elements.

8. The burner port arrangement of claim 5, wherein locations where the fastening elements are coupled with the T-shaped elements are separated from one another between adjacent inner plates so that a gas mixture flowing inside a bottom of one of the inner plates is diverted to a passage of the inner plate, due to the fastening elements, passes through a space inside the adjacent inner plates, and is discharged via the burner ports on top of one of the inner plates.

9. The burner port arrangement of claim 5, including bottom supporting frames having fitting grooves corresponding to a bottom surface of the burner body unit, wherein both longitudinal sides of the bottom surface of the burner body unit are coupled to the bottom supporting frame and are fastened to the bottom supporting frames with the plates overlapped with one another.

* * * * *